US006647094B2

(12) United States Patent
Harding et al.

(10) Patent No.: US 6,647,094 B2
(45) Date of Patent: Nov. 11, 2003

(54) X-RAY SOURCE PROVIDED WITH A LIQUID METAL TARGET

(75) Inventors: Geoffrey Harding, Hamburg (DE); Jens Peter Schlomka, Hamburg (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/174,665

(22) Filed: Jun. 19, 2002

(65) Prior Publication Data

US 2003/0016789 A1 Jan. 23, 2003

(30) Foreign Application Priority Data

Jun. 19, 2001 (DE) ..... 101 29 463

(51) Int. Cl.[7] ..... H01J 35/08
(52) U.S. Cl. ..... 378/143; 378/119
(58) Field of Search ..... 378/143, 140, 378/119, 130, 127, 125, 121, 138, 141

(56) References Cited

U.S. PATENT DOCUMENTS 3,246,146 A * 4/1966 cohen et al. ..... 250/49.5
4,723,262 A * 2/1988 Noda et al. ..... 378/119
4,953,191 A 8/1990 Smither et al.
5,052,034 A * 9/1991 Schuster ..... 378/121
6,185,277 B1 2/2001 Harding

* cited by examiner

*Primary Examiner*—David V. Bruce
*Assistant Examiner*—Irakli Kiknadze
(74) *Attorney, Agent, or Firm*—Eugene E. Clair, Esq.

(57) ABSTRACT

The invention relates to an arrangement for generating X-rays upon incidence of electrons (4), which arrangement includes a liquid metal zone (7) in which a liquid metal (9) is provided as an X-ray target in such a manner that it can flow past a zone of electron incidence (8). In order to allow a pump of reduced capacity to be employed in such a device in order to provide the movement of the liquid metal, in accordance with the invention it is proposed to realize a pressure zone (10) which is separate from the liquid metal zone (7) and is provided with a pressure medium (11) in such a manner that the pressure medium (11) can exert a pressure on the liquid metal (9) present in the liquid metal zone (7) in order to force the liquid metal (9) past the zone of electron incidence (8), the pressure zone (10) being provided with a pressure accumulator (R3) which can be replenished in order to apply the pressure.

14 Claims, 3 Drawing Sheets

X-RAY SOURCE PROVIDED WITH A LIQUID METAL TARGET

BACKGROUND

The invention relates to an arrangement for generating X-rays upon incidence of electrons, which arrangement includes a liquid metal zone in which a liquid metal is provided as an X-ray target in such a manner that it can flow past a zone of electron incidence. The invention also relates to an X-ray source which includes an electron source for the emission of electrons and such an arrangement for generating X-rays. Finally, the invention also relates to an X-ray device which includes an X-ray detector and such an X-ray source.

An arrangement and an X-ray source of this kind are known from U.S. Pat. No. 6,185,277 B1. Therein, the electrons emitted by an electron source penetrate the liquid metal through a thin window and generate X-rays therein. The liquid metal, having a high atomic number, circulates therein under the influence of a pump, so that the heat produced by the interaction with the electrons in the window and in the liquid metal can be dissipated. The heat produced in this zone is carried off by a turbulent flow, thus ensuring effective cooling.

A number of different applications is feasible for such an arrangement for generating X-rays. In the case of a computed tomography apparatus, an X-ray source is required which is capable of delivering a high pulsed power of, for example, approximately 80 kW for a brief period of time only, for example, for approximately 20 s. For a different type of application, that is, in an X-ray system for the inspection of luggage, for example, for the presence of explosives or drugs, however, a lower power of only, for example, approximately 30 kW is required, be it that this power has to be delivered continuously, that is, for several hours.

SUMMARY OF THE INVENTION

For the known X-ray source provided with a liquid metal target, in which the liquid metal is circulated by means of a pump, it has since long been assumed that the described conditions can be satisfied by means of a single pump. However, it has been found that for the first type of application, that is, in computed tomography, the required pulsed power is very high, but the mean power is much lower. Assuming that each period of use of approximately 20 s is typically preceded by an idle time of approximately 80 s, the mean electric power then amounts to (80 kW.20 s)/(80 s+20 s)=16 kW. Consequently, it should also be possible to reduce the power of the pump accordingly, that is, to conceive the pump for the required mean power of approximately 16 kW instead of for the maximum pulsed power of 80 kW; this would offer a significant saving in respect of space and costs.

The present invention, therefore, has for its object to provide an arrangement for generating X-rays which is provided with a liquid metal target and can be used for various applications and requires only a comparatively small pumping capacity for the liquid metal. On the basis of the arrangement of the kind set forth, this object is achieved in that a pressure zone which is separate from the liquid metal zone is provided with a pressure medium in such a manner that the pressure medium can exert a pressure on the liquid metal present in the liquid metal zone in order to force the liquid metal past the zone of electron incidence, the pressure zone being provided with a pressure accumulator which can be replenished in order to apply the pressure.

In accordance with the invention it was recognized that the pumping capacity required for forcing the liquid metal past the zone of electron incidence need not be conceived for the highest electric (pulsed) power, but that the required pumping capacity can be tuned to the mean electric power required when supplementary means are provided for the storage of pumping capacity. Assuming that the energy required to move a liquid volume V through a pressure difference amounting to $\Delta P$ equals $V.\Delta P$, the pump requires a capacity of $1/\epsilon.(V.\Delta P)/T$. The value $\epsilon$ takes into account the fact that the conversion of mechanical energy into hydrodynamic energy has an efficiency of less than 100%; T is the period of time over which the energy transfer to the liquid metal can be distributed. The pumping capacity can thus be significantly reduced by distributing the supply of energy in the form of pumping energy over 100 s (in the above example concerning computed tomography) instead of concentrating it to 20 s only.

Thus, in accordance with the invention the following conditions must be satisfied:

a) the energy for driving the liquid metal can be effectively stored, replenished and extracted in a short period of time whenever necessary;

b) the type of energy storage is compatible with the condition that the liquid metal must be driven in a pump-like fashion.

The foregoing is achieved in accordance with the invention in that, unlike in the known X-ray source, the liquid metal is not circulated by means of a pump but is situated exclusively in a liquid metal zone in which it can be moved to and fro, however, without being circulated. Furthermore, there is provided a pressure zone which is separate therefrom and also includes a pressure accumulator in which energy can be stored so as to be extracted for moving the liquid metal in the liquid metal zone with the desired power, that is, for conducting the liquid metal past the zone of electron incidence. In order to recharge the pressure accumulator, that is, to replenish energy, there may be provided a recharging device, for example, a pump which has a capacity which is significantly lower than that of the pump in the known X-ray source, because the energy in the pressure accumulator can now be dispensed at any time, that is, also during the idle periods of the X-ray source, whereas in the known X-ray source the full pumping capacity must be made available during operation. Such a recharging device, therefore, can be constructed so as to save room and money and also enables universal use of such an X-ray source.

Preferably, the liquid metal zone and the pressure zone adjoin one another in two locations, that is, in two so-called separation zones, in which a pressure can be exerted on the liquid metal by means of the pressure medium. Such separation zones may be conceived, for example, as respective separating chambers with a liquid metal chamber and a pressure medium chamber each, the liquid metal and the pressure medium being separated by a flexible diaphragm via which the pressure can be transferred from the pressure medium to the liquid metal. The liquid metal as well as the pressure medium can thus expand into the relevant separating chamber as a function of the adjusted pressure ratio.

Other solutions are also feasible for the conception of the liquid metal zone and the pressure zone. However, it is a common aspect of all such solutions that a pressure is exerted indirectly, via the pressure medium, on the liquid metal in the liquid metal zone, so that the liquid metal is not driven directly. The separation zones may thus also be construed as a cylinder with a respective displaceable piston, where the piston serves as a separating means between the liquid metal and the pressure medium; it can in principle also be constructed so as to be driven in an arbitrary manner.

Various alternatives for the pressure medium are disclosed in which a gas, notably air, is preferably used as the pressure medium.

For the control of the application of pressure to the liquid metal, and hence for the control of the flow velocity of the liquid metal in the zone of electron incidence, there are provided appropriate control means. These control means may notably be provided with the previously mentioned controllable valves via which the application of pressure from the pressure accumulator to the liquid metal zone, notably to the separating zones, can be controlled.

In order to achieve an as high as possible flow velocity in the zone of electron incidence, the liquid metal zone may be provided with a constriction at the area of said zone of incidence. This constriction may be conceived so as to be asymmetrical to both sides of the zone of electron incidence, for example, so as to approach the external shape of a drop of water, so that the loss of pressure incurred by the liquid metal flowing through the constriction is as small as possible. However, in that case it is necessary to take into account the fact that during operation the liquid metal should always flow through the constriction in one direction only in order to ensure that the greatest possible desired effect is achieved.

During operation the liquid metal is heated up to a few 100° C. In order to cool the heated liquid metal, therefore, cooling means, for example, in the form of cooling ducts which extend around the separating zone, are provided in at least one of the two separating zones in which the liquid metal is preferably present after a period of use.

The arrangement for generating X-rays preferably forms part of an X-ray source which includes an electron source for the emission of electrons. Such an X-ray source is preferably used in conjunction with an X-ray detector in an X-ray device.

The following description, claims and accompanying drawings set forth certain illustrative embodiments applying various principles of the present invention. It is to be appreciated that different embodiments applying principles of the invention may take form in various components, steps and arrangements of components and steps. These described embodiments being indicative of but a few of the various ways in which some or all of the principles of the invention may be employed in a method or apparatus. The drawings are only for the purpose of illustrating an embodiment of an apparatus and method applying principles of the present invention and are not to be construed as limiting the present invention.

BRIEF DESCRIPTION OF THE DRAWINGS

The foregoing and other features and advantages of the present invention will become apparent to those skilled in the art to which the present invention relates upon consideration of the following detailed description of apparatus applying aspects of the present invention with reference to the accompanying drawings, wherein.

DETAILED DESCRIPTION

Figure 1:
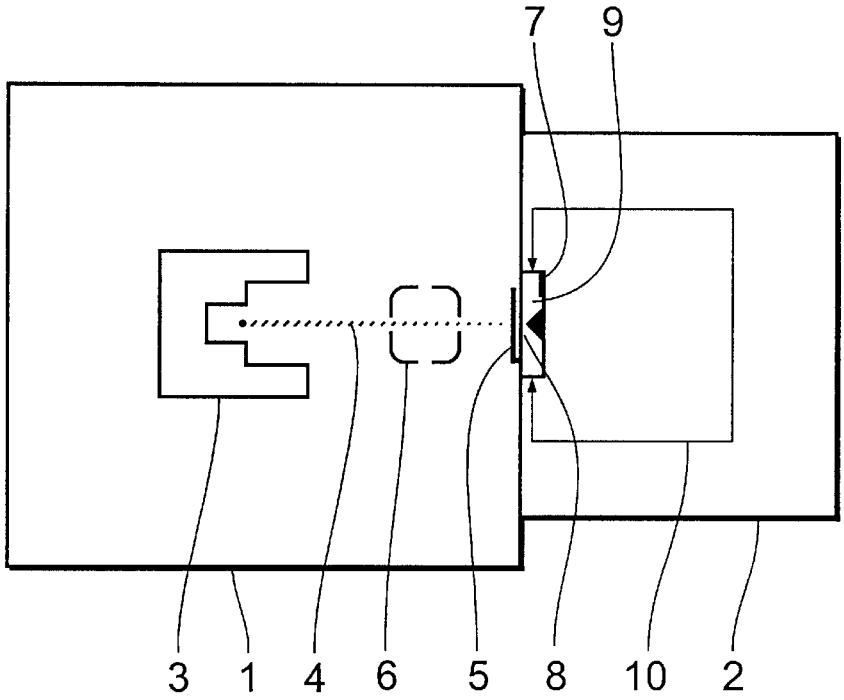
FIG. 1 is a diagrammatic representation of an X-ray source in accordance with the invention.

FIG. 1 is a diagrammatic representation of an X-ray source in accordance with the invention in which the reference numeral 1 denotes a tube envelope which is preferably grounded and is sealed in a vacuumtight manner by way of a window 5. In the vacuum space of the tube envelope there is provided an electron source in the form of a cathode 3 which emits an electron beam 4 in the operating condition, which beam is incident, via the window 5, on a liquid metal 9 which is present in an arrangement 2 in accordance with the invention for generating X-rays. The arrangement 2 comprises essentially a liquid metal zone 7 in which a liquid metal 9 is present so as to be struck by the electron beam 4 in a zone of electron incidence 8. The arrangement 2 also comprises a pressure zone 10 via which a pressure can be exerted on the liquid metal 9 in the liquid metal zone 7 in order to ensure that the liquid metal 9 flows past the zone of electron incidence 8 at a desired speed during operation.

The interaction between the electrons 4 traversing the window 5 and the liquid metal 9 produces X-rays which emanate via the window 5 and an X-ray exit window 6 in the tube envelope 1. The liquid metal 9 thus serves as the X-ray target. For the further conception of the X-ray source shown, that is, notably of the electron beam 4, the window 5 and the liquid metal 9, reference is made to the cited document U.S. Pat. No. 6,185,277 B1 whose embodiments that are of relevance in this context have the same validity for the present X-ray source and are, therefore, considered to be incorporated in the present application.

Figure 2A:
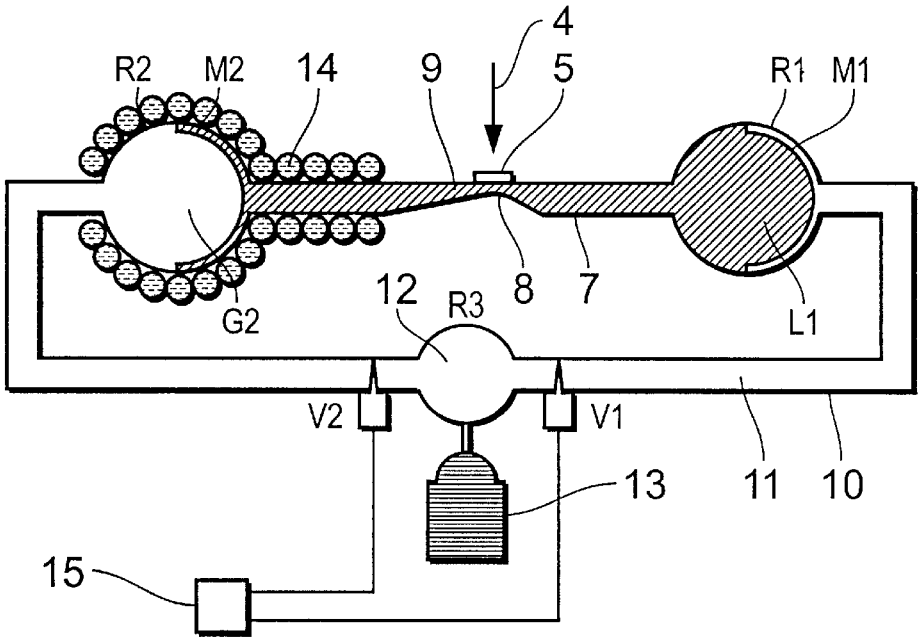
FIGS. 2*a* to 2*c* are diagrammatic representations of an arrangement in accordance with the invention for generating X-rays in different operating states.
Figure 2B:
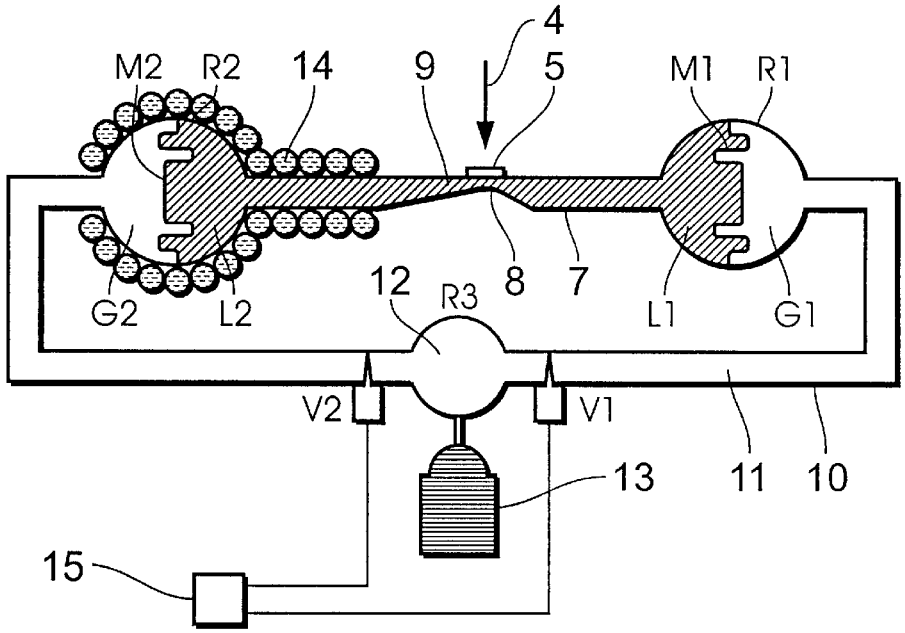
Figure 2C:
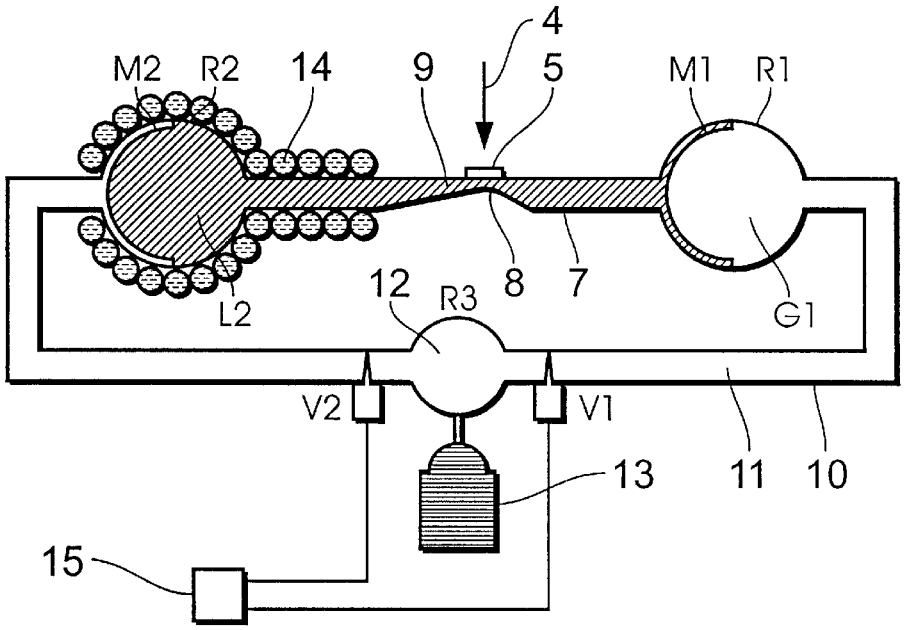

The FIGS. 2*a* to 2*c* are diagrammatic representations of the arrangement 2 in different operating states. FIG. 2*a* shows the initial state of the arrangement 2, that is, directly before the start of operation, while FIG. 2*b* shows the operating state during operation and FIG. 2*c* shows the final state after use.

As can be seen in the Figures, the liquid metal zone 7 in which the liquid metal 9 is present is constructed as an elongate tube. In the zone of electron incidence 8, that is, in the zone behind the window 5, said tube is provided with a constriction. Furthermore, the two ends of the tubular liquid metal zone 7 widen into separating chambers R1 and R2. The separating chambers are provided with a respective flexible diaphragm M1, M2 which subdivides the separating chambers R1, R2 into a respective liquid metal chamber L1, L2 and a pressure chamber G1, G2 (see FIG. 2*b*). The pressure chambers G1, G2 already form part of the pressure zone 10 in which a pressure medium 11 is present; this medium is, for example, a gas such as notably air in the present embodiment. This pressure zone 10 is also constructed so as to be essentially tubular and its two ends also widen so as to form said pressure chambers G1, G2. Additionally, within the tubular pressure zone 10 there is provided a pressure accumulator R3, that is, in the form of a pressure chamber in the present embodiment in which a high pressure can be stored. To this end, a gas 12, for example, air is pumped into the pressure chamber R3 by means of a pump 13 until a desired high pressure prevails therein.

Between the pressure chamber R3 and the two separating chambers R1 and R2 there is provided a respective valve V1, V2 which is controlled by a control device 15 and via which a pressure of the desired value can be exerted on the diaphragms M1 and M2 at desired instants. The valves V1 and V2 may notably be constructed as computer-controlled valves which should essentially have three different functions or positions:

a) they are closed so as to prevent a flow of gas;
b) they are opened so as to enable a flow of gas;
c) they must enable a flow of gas in different directions, notably from the pressure accumulator R3 to the separating chambers R1 and R2 (with a desired pressure level) and from the separating chambers R1 and R2 to the environment so as to reduce the pressure in the separating chambers R1 and R2.

For example, a pressure of 200 bar may be envisaged in the pressure accumulator R3. The pump 13 may then be constructed as a gas compressor which operates with a 50 Hz motor, a piston of a radius of 25 mm, and a length of stroke of 60 mm. The pump volume is then 118 $cm^3$ and the volume of compressed gas (at 200 bar) which is delivered per second amounts to approximately 30 $cm^3$. The separating chambers R1 and R2 may have a respective volume of 4 l and be capable of withstanding a maximum pressure of 100 bar. These parameters necessitate a radius of the separating chambers R1 and R2 of approximately 10 cm and a weight of approximately 3 kg.

For the liquid metal use is preferably made of an alloy which consists of 35.6% Bi (eutectic), 22.9% Pb, 19.6% In and 21.9% Sn (stated in percents by weight). The melting point of this alloy lies at 56.5° C. In the initial state as shown in FIG. 2*a*, that is, the state in which the X-ray source is inactive, the separating chamber R1 is practically empty and the separating chamber R2 is practically full. The liquid metal can then be maintained at a temperature of approximately 65° C., that is, in the liquid state, in the separating chamber R2 by employing heating elements (not shown).

Figure 3:
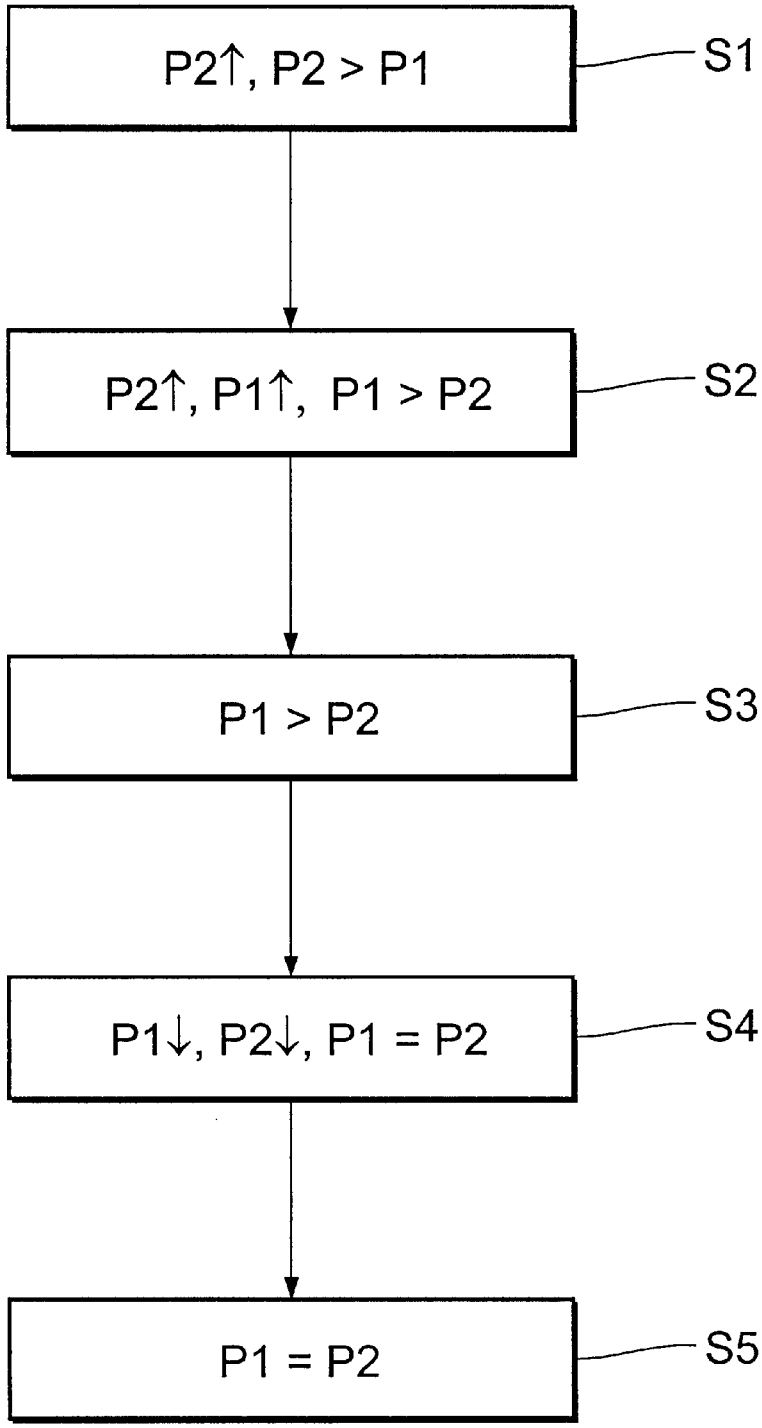
FIG. 3 shows a flow chart illustrating the various operating states of an arrangement in accordance with the invention for generating X-rays.

The various operating states as shown in FIGS. 2*a* to 2*c* and described in detail in the flowchart of FIG. 3 will now be described in detail, it being assumed that the X-ray source in accordance with the invention is used in a computed tomography apparatus for the acquisition of data. First of all, in a first step (S1 in FIG. 3) it is ensured that the initial state as shown in FIG. 2*a* is reached before the acquisition of data commences. To this end, the pressure P2 in the pressure chamber G2 of the separating chamber R2 is increased a few bar, for example, to 3 bar, so that the liquid metal flows completely out of the separating chamber R2 and is collected completely in the separating chamber R1. To this end, the valve V2 is opened slightly so as to introduce a slight pressure from the pressure accumulator R3 into the separating chamber R2. The valve V1, however, is opened relative to the environment, so that atmospheric pressure prevails in the gas pressure chamber G1.

When the initial state shown in FIG. 2*a* is reached, the valve V1 is opened towards the pressure accumulator R3 a few seconds before the beginning of the acquisition of the data, so that the pressure P1 in the gas pressure chamber G1 very quickly reaches the operating level. As a result, the liquid metal 9, being completely present in the liquid metal chamber L1 of the separating chamber R1, is forced out of the separating chamber R1 under the influence of the pressure acting on the diaphragm M1, so that it flows at a high speed through the constriction 8 in the zone of electron incidence. In order to avoid cavitations which could occur in the constriction 8 because of the Bernoulli effect, preferably at the same time a counterpressure P2 is produced in the gas pressure chamber G2 of the separating chamber R2. To this end, simultaneously with the opening of the valve V1 the valve V2 is opened towards the pressure accumulator R3 (step S2 in FIG. 3). For example, for the pressure P1 in the separating chamber R1 a value of from 40 to 70 bar, preferably 50 bar, can be adjusted and a pressure P2 of, for example, 20 bar (or less, that is, even as low as 1 bar) can be adjusted in the separating chamber R2, so that a pressure difference P1–P2 of preferably from 20 to 50 bar prevails.

The X-ray source in accordance with the invention operates in this operating state (step S3 in FIG. 3); the electron beam is thus switched on and X-rays are generated. The liquid metal 9 then flows from the separating chamber R1 to the separating chamber R2 at the desired speed of, for example, 100 $cm^3/s$ for the duration of the data acquisition, for example, 20 s in the case of CT. The valves V1 and V2 are then continuously open (or completely or partly closed) so as to create the necessary operating pressure. Evidently, the pressure accumulator R3 must have a capacity which suffices to maintain the high pressure P1 of, for example, 40 to 70 bar for an adequate period of time, thus enabling the liquid metal 9 to flow from the separating chamber R1 to the separating chamber R2 for a sufficiently long period of time and also at an adequate speed. In one embodiment, for example, it may be arranged that the pressure accumulator R3 has a volume of approximately 3 l with a maximum pressure of 200 bar.

When the acquisition of data is terminated, the electron beam 4 is switched off and the valves V1 and V2 are opened relative to the atmosphere again, so that the pressure P1 and P2 again decrease to atmospheric pressure (step S4). The liquid metal 9 is then present mainly or completely in the separating chamber R2 as shown in FIG. 2*c*. Because the liquid metal 9 has been heated because of the incidence of electrons 4 in the zone of electron incidence 8, cooling ducts 14 are provided so as to cool the liquid metal 9 in the separating chamber R2, that is, preferably to a temperature of from 60 to 65° C., so that the liquid metal 9 remains in the liquid state.

Finally, in a last step (S5) the pump 13 ensures that the pressure in the pressure accumulator R3 is "replenished" so that adequate pressure is available again for the next run. The capacity of the pump 13 therefore, need not be conceived for the highest capacity which must be made available during operation of the X-ray source; it need merely be conceived so as to be such that the pressure can be adjusted to an adequate high value again in the pressure accumulator R3 during the idle period. In contrast therewith the pump in the known X-ray source must be designed for the complete operating power.

As can be readily seen in the FIGS. 2*a* to 2*c*, the constriction 8 behind the window 5 is designed so as to be asymmetrical relative to the separating chambers R1 and R2. The aim is to ensure that the pressure loss incurred by the liquid metal 9 flowing from the separating chamber R1 to the separating chamber R2 during operation is as small as possible, so that an as high as possible liquid flow velocity is achieved in the zone of electron incidence. The arrangement shown, therefore, should only be used in such a manner that the liquid metal 9 is always forced from the separating chamber R1 into the separating chamber R2 during operation.

Alternatively, however, the constriction 8 may also be designed so as to be symmetrical and it is also possible to provide cooling ducts 14 around the separating chamber R1, so that the liquid metal 9 can be forced in both directions during operation.

Alternative to the embodiment shown, other possibilities also exist for exerting the pressure on the liquid metal. For example, instead of the gas 11 use can be made of a liquid which has a very low boiling point and which can be made to boil by means of a heating device (so that it evaporates) so as to achieve a high pressure. The evaporated liquid can then be stored in a vapor accumulator so as to exert the necessary pressure on the liquid metal during operation. In this arrangement a pump could be completely dispensed with. Only heating devices would be required instead. A mechanical motion, for example, as it takes place in a pump, could thus be completely dispensed with; this is advantageous notably when an X-ray source of this kind is used in a CT gantry.

While a particular feature of the invention may have been described above with respect to only one of the illustrated embodiments, such features may be combined with one or more other features of other embodiments, as may be desired and advantageous for any given particular application. From the above description of the invention, those skilled in the art will perceive improvements, changes and modification. Such improvements, changes and modification within the skill of the art are intended to be covered by the appended claims.

Having described a preferred embodiment of the invention, the following is claimed:

1. A liquid metal X-ray target apparatus comprising:

a liquid metal zone;

a zone of electron incidence, a liquid metal X-ray target flowing in the liquid metal zone past the zone of electron incidence; and a pressure zone separate from the liquid metal zone, the pressure zone including:

a pressure medium exerting a pressure on the liquid metal in the liquid metal zone causing the liquid metal to flow past the zone of electron incidence; and a pressure accumulator operatively connected to the pressure zone to apply pressure to the pressure medium.

2. The apparatus of claim 1 wherein the liquid metal zone and the pressure zone are separated from one another by respective separating means so as to adjoin one another in two separating zones, the separating means constructed so as to be movable in such a manner that pressure can be exerted on the liquid metal via the separating means in both separating zones.

3. The apparatus of claim 2 wherein the separating zones are provided as two-piece separating chambers with a respective liquid metal chamber and a pressure medium chamber, the chambers separated from one another by a flexible diaphragm.

4. The apparatus of claim 2 wherein the separating zones are constructed as cylinders with a displaceable piston.

5. The apparatus of claim 2 wherein at least one of the separating zones includes cooling means.

6. The apparatus of claim 1 including a gas as the pressure medium, a gas pressure chamber as the pressure accumulator and a pump to replenish the pressure accumulator.

7. The apparatus of claim 1 including a hydraulic liquid as the pressure medium and a hydraulic pressure chamber is provided as the pressure accumulator.

8. The apparatus of claim 1 including a liquid as the pressure medium and a vapor chamber as the pressure accumulator wherein the liquid in the pressure accumulator is evaporated in order to replenish the pressure accumulator.

9. The apparatus of claim 1 including control means for controlling the application of a desired pressure to the liquid metal in such a manner that the liquid metal flows past the zone of electron incidence at a desired flow speed.

10. The apparatus of claim 9 wherein the control means includes controllable valves in the pressure zone to control the pressure from the pressure accumulator exerted on the liquid metal in the liquid metal zone.

11. The apparatus of claim 1 wherein the liquid metal zone includes a constriction in the zone of electron incidence and the constriction is asymmetrical at the sides of the zone of electron incidence.

12. The apparatus of claim 1 including an electron source.

13. The apparatus of claim 12 including an X-ray detector.

14. The apparatus of claim 1 wherein the pressure accumulator is replenishable.

* * * * *